US007473335B2

(12) United States Patent
Wanke et al.

(10) Patent No.: US 7,473,335 B2
(45) Date of Patent: Jan. 6, 2009

(54) APPARATUS AND METHOD FOR MONITORING THE TRANSFER OF A MATERIAL WEB

(75) Inventors: Tobias Wanke, Neu-Ulm (DE); Uwe Joos, Königsbronn (DE)

(73) Assignee: Voith Paper Patent GmbH, Heidenheim (DE)

( * ) Notice: Subject to any disclaimer, the term of this patent is extended or adjusted under 35 U.S.C. 154(b) by 428 days.

(21) Appl. No.: 11/233,966

(22) Filed: Sep. 23, 2005

(65) Prior Publication Data

US 2006/0070713 A1 Apr. 6, 2006

(30) Foreign Application Priority Data

Sep. 27, 2004 (DE) ..... 10 2004 046 795

(51) Int. Cl.
*D21F 11/00* (2006.01)

(52) U.S. Cl. ..... 162/198; 162/263; 162/272; 34/114

(58) Field of Classification Search ..... 162/198, 162/263, 272, 255, 193; 34/114
See application file for complete search history.

(56) References Cited

U.S. PATENT DOCUMENTS

| | | | | |
|---|---|---|---|---|
| 3,016,622 | A * | 1/1962 | Gade et al. | 34/525 |
| 4,905,379 | A | 3/1990 | Wedel et al. | |
| 5,190,201 | A * | 3/1993 | Briggs | 226/1 |
| 5,280,720 | A * | 1/1994 | Heidt | 73/159 |
| 5,600,897 | A | 2/1997 | Sollinger et al. | |
| 5,862,608 | A * | 1/1999 | Kotitschke | 34/117 |
| 5,942,689 | A * | 8/1999 | Bonissone et al. | 73/598 |
| 2003/0000671 | A1 | 1/2003 | Dick et al. | |

FOREIGN PATENT DOCUMENTS

| | | |
|---|---|---|
| DE | 42 16 653 | 5/1992 |
| DE | 100 31 163 A1 | 6/2000 |
| DE | 201 03 070 | 2/2001 |
| DE | 101 31 281 | 6/2001 |
| DE | 101 57 914 | 11/2001 |
| EP | 0 660 898 B1 | 10/1993 |
| EP | 1 270 475 A2 | 5/2002 |

OTHER PUBLICATIONS

European Search Report May 17, 2006.

* cited by examiner

*Primary Examiner*—Mark Halpern
(74) *Attorney, Agent, or Firm*—Taylor & Aust, P.C.

(57) ABSTRACT

A machine for producing and/or treating a material web, in particular of paper or board, in which the material web can be guided along a material web guide path by means of at least one material web guide device from a material web production section or material web input section, in order to pass at least one material web treatment device, having an apparatus for forming a transfer strip of the material web and transferring the transfer strip through the machine, it being possible for the material web to be transferred along the material web guide path in that, by means of the apparatus for forming and transferring the transfer strip, a leading transfer strip of the material web is formed and guided through the machine, and the width of the transfer strip is increased to the full material web width (what is known as "tail widening"), and having an apparatus for detecting a break in the material web. The apparatus for detecting a break in the material web is provided and designed for the purpose of responding to a break in the transfer strip or the material web during the transfer of the material web, in particular during the increase in the width of the transfer strip.

10 Claims, 3 Drawing Sheets

APPARATUS AND METHOD FOR MONITORING THE TRANSFER OF A MATERIAL WEB

CROSS-REFERENCE TO RELATED APPLICATIONS

The present application claims priority under 35 U.S.C. §119 of German Patent Application No. 10 2004 046 795.1 filed on Sep. 27, 2004, the disclosure of which is expressly incorporated by reference herein in its entirety.

BACKGROUND OF INVENTION

1. Field of the Invention

The invention relates to a machine for producing and/or treating a material web, in particular of paper or board, in which the material web can be guided along a material web guide path by means of at least one material web guide device from a material web production section or material web input section, in order to pass at least one material web treatment device, having an apparatus for forming a transfer strip of the material web and transferring the transfer strip through the machine, it being possible for the material web to be transferred along the material web guide path in that, by means of the apparatus for forming and transferring the transfer strip, a leading transfer strip of the material web is formed and guided through the machine, and the width of the transfer strip is increased to the full material web width (what is known as "tail widening"), and having an apparatus for detecting a break in the material web.

The invention relates further to a method for monitoring the transfer of a material web of paper or board along a material web guide path of a machine for producing and/or treating the material web, the transfer of the material web being carried out in that a leading transfer strip of the material web is guided through the machine and the width of the transfer strip is increased to the full material web width (what is known as "tail widening").

2. Discussion of Background Information

What is known as web threading in a machine for producing and/or treating a material web, specifically a material web of paper or board, is normally carried out by means of at least one transfer strip, which is divided off from the material web and is then guided through following guide and/or treatment devices. This type of web threading is standard both in papermaking and boardmaking machines having in each case at least one head box, a wet end (in particular wire section and/or press section), and a drying section, possibly one or more processing sections (for example a coating section) and also in paper or board processing machines provided for the off-line treatment of a material web produced in another way, for example what are known as coating machines. In order to form or divide off the transfer strip, diverse devices are known. For example, what are known as strip knock-off devices, water jet cutting devices, laser cutting devices and so on are used. In connection with papermaking machines, use is normally specifically made of what is known as a "couch jet" which, on a wire of the wire section, cuts a strip into the paper web (or board or tissue web), which is then guided through the further sections of the machine, in particular at least one press section and at least one drying section and, if appropriate, at least one treatment section. In the case of transfer devices which are mounted downstream of the drying section, what is known as a tip cutter is used instead of the couch jet. As soon as the transfer strip is running stably through the machine, it is then possible, by using the couch jet on the wire, to move to the "full width", that is to say approximately from a strip position adjacent to the operator side to the drive side or, vice versa, from a strip position adjacent to the drive side to the operator side, as a result of which the full web width then automatically runs through the machine. In the specialist field, one speaks of what is known as "tail widening" in this connection. This type of web threading or similar type of web threading (for example, the transfer strip could also be formed in a central region of the material web) has also proven worthwhile in relation to all the conventional material web treatment devices, those designed as an online material web treatment device and designed as an off-line material web treatment device, such as press sections, predryer sections, afterdryer sections, coating machines, smoothing units (for example calenders), reelers and so on.

However, existing web break detection systems only monitor the "normal operation" for a web break, specifically when the material web has already been threaded. Various types of web break detector are known, for example based on detecting the web speed (cf., for example, DE 101 57 914 A1), the detection of a temperature change (cf., for example, DE 101 31 281 A1), the optical detection of surface characteristics (cf., for example, DE 201 03 070 U1 and DE 42 16 653 C2) and the detection of pressures or pressure changes in connection with a vacuum web guiding device, in particular suction roll (cf., for example, EP 0 660 898 B1 and DE 100 31 163 A1). Conventionally, break monitoring is therefore not effective or is deactivated during tail widening. If a break occurs during tail widening, this must be detected by the operating personnel and it is then necessary for all the measures to be initiated manually in order to avoid damage to the machine and in order to be able to re-thread (to transfer) the material web. This applies in spite of the fact that, in modern papermaking machines, the aim is generally to increase the production efficiency. What stands in the way of automatic web break detection is the thought that the introduction of the transfer strip into the machine and tail widening are transient, not steady state, processes or states, which should be monitored better by human beings for greater reliability.

SUMMARY OF THE INVENTION

Surprisingly, it has been shown that, even in connection with the transfer of the transfer strip and, above all, in connection with the tail widening, automatic, machine-based monitoring for the occurrence of a web break can be carried out with high reliability. For the machine mentioned at the beginning, according to a first aspect of the invention, it is accordingly proposed that the apparatus for detecting a break in the material web be provided and designed for the purpose of responding to a break in the transfer strip or the material web during the transfer of the material web, in particular during the increase in the width of the transfer strip. In relation to the method mentioned at the beginning, the invention proposes that, during the increase in the width of the transfer strip, monitoring for a break in the transfer strip or the material web is carried out.

On the basis of the invention, failures during web threading, specifically during tail widening, can be detected automatically and therefore quickly, and a re-start of the web threading and tail widening can be introduced quickly and automatically. The transfer times occurring over the operation of the machine can be reduced in this way, which means that a higher level of productivity is reached. The automated monitoring and, if appropriate, initiation of suitable reactive measures is also advantageous inasmuch as damage to machine components as a result of a web break can be avoided, in particular by triggering web knock-off in the event of a web break. Furthermore, as already mentioned, thought is above all also given to all the necessary reactive measures being initiated automatically in response to the detection of a web break, in order to be able to re-transfer the material web. For example, by activating the appropriate actuators, for example vacuum breaker valves can be closed, the couch jet or, generally, a transfer strip forming device can be moved to the strip position, fan rotational speeds can be lowered, to name only a few examples. The web transfer can therefore be carried out more quickly and more successfully. The initiation of appropriate measures (knocking off the web and preparing the renewed web transfer) manually by the operating personnel can be dispensed with.

If the tail widening was successful, that is to say no break occurred during the transfer of the transfer strip and during the tail widening, then a change can expediently be made automatically to "normal operation", in which the conventional break monitoring can then be carried out, for example in accordance with the solutions from the prior art mentioned above.

Thought is above all given to the apparatus for detecting a break in the material web being designed for the purpose of responding to a break in the transfer strip or the material web on the basis of at least one detection variable representing the width of the transfer strip, directly or indirectly. As based on the method according to the invention, provision can accordingly be made for monitoring for a break in the transfer strip or the material web to be carried out on the basis of at least one detection variable representing the width of the transfer strip, directly or indirectly.

The development proposal is based on the thought that the width of the transfer strip at a given position along the material web guide path is a measure of the progress of the tail widening. In the case of successful web threading, the width of the transfer strip at a reference position must correspond to the width of the transfer strip at the location of the formation of the transfer strip at a preceding time depending on the web running speed. If, by means of appropriate activation of the couch jet or, generally, the device for forming the transfer strip, provision is made for the transfer strip to become continuously wider during tail widening, this must also apply at another point along the material web guide path, as long as the web threading is carried out properly and, in particular, no web break occurs.

In principle, all the web break detection and monitoring techniques known from the prior art are suitable in connection with the break detection and monitoring according to the invention. For example, the apparatus for detecting a break can for example have an optical detection arrangement in order to detect a web break or to provide the detection variable. As based on the method according to the invention, it is proposed that the monitoring be carried out on the basis of optical detection, in particular optical detection of the width of the transfer strip. Furthermore, the apparatus for detecting a break can have a temperature detection arrangement, in order to detect a web break or to provide the detection variable. As based on the method according to the invention, it is proposed that the monitoring be carried out on the basis of detection of temperature values.

By contrast, provision is particularly preferably made for the apparatus for detecting a break to have a pressure detection arrangement or pressure change detection arrangement, in order to detect a web break or to provide pressure values as detection variable. In relation to the method according to the invention, it is proposed as particularly preferable that the monitoring be carried out on the basis of detection of pressure values or pressure change values or a pressure change.

Advantageously, in each case at least one dedicated pressure detection arrangement or pressure change detection arrangement can be provided for a plurality of sections of the machine, for example a plurality of drying groups or other treatment devices, in order in each section to detect a web break immediately and therefore with very quick reaction in each case or to provide pressure values as detection variable for the web break detection.

In connection with these development proposals, thought is above all given to the pressure detection arrangement or pressure change detection arrangement being designed and arranged for the purpose of detecting at least one instantaneous operating pressure of at least one vacuum device acting on the material web or the transfer strip. For example, thought is given to what is known as a suction roll, which is used for material web guidance and, possibly, web deflection. Alternatively or additionally, a or the pressure detection arrangement or pressure change detection arrangement can be designed and arranged for the purpose of detecting at least one instantaneous operating pressure of at least one positive pressure device acting on the material web or the transfer strip. In this connection, thought is given, for example, to what is known as an air turn, which is used for non-contact web guidance and, possibly, web deflection.

Based on the method according to the invention, it is proposed that at least one instantaneous operating pressure of at least one vacuum device or positive pressure device acting on the material web or transfer strip be detected.

The background to these development proposals is that, during tail widening, the vacuum device or positive pressure device is increasingly covered by the transfer strip becoming wider or the material web becoming wider, which, in a vacuum device increases the vacuum as a result of an air stream becoming smaller, that is to say reduces the prevailing operating pressure, and, in a positive pressure device, because of increasing throttling of the air discharge, increases the positive pressure, that is to say can increase the operating pressure. The operating pressure prevailing in the vacuum or positive pressure device to this extent reflects the width of the material web or of the transfer strip on the device.

As a rule, it will be expedient if the relevant vacuum device or positive pressure device is provided in any case, in order at least to participate in the guidance of the material web or of the transfer strip as part of the material web guide device.

The vacuum device can comprise at least one suction roll and/or at least one suction box and/or at least one vacuum transport belt. The positive pressure device can comprise at least one blower roll and/or at least one blower box and/or at least one air turn.

As particularly preferred, it is proposed that at least one pressure sensor of the pressure detection arrangement be arranged in the/a suction box or blower box. In the case of a suction roll, the pressure sensor is preferably arranged in a suction box assigned to the suction roll. As compared with a solution known per se, in which the pressure sensor is provided in a line connecting the suction box to a vacuum source, this offers the great advantage that high pressure fluctuations occurring acyclically, the cause of which has not yet been fully explained, can be avoided. The problem of measuring the pressure in a suction line could be that the pressure measurement is influenced by the flow velocity of the air. Influences of this type are avoided if the pressure is measured in the suction box. More reliable monitoring of the transfer of the material web and, generally, more reliable break monitoring are achieved.

If the suction box comprises a transfer suction zone which is assigned to the transfer strip and an operating suction zone which, together with the transfer suction zone, is assigned to the full material web width and which is connected or is able to be connected via the transfer suction zone to a vacuum source, then the pressure sensor is preferably arranged in the operating suction zone. Between the transfer suction zone and the operating suction zone, at least one connecting opening or connecting line that can be closed by a valve flap or the like can be provided and, for the pure introduction of the narrow threading section of the transfer strip, is closed, in order to be able to attract the latter with sufficient vacuum. For the tail widening, this connecting opening or connecting line is then opened, in order to be able to monitor the proper widening of the transfer strip or the material web via the operating pressure.

The machine can advantageously have an evaluation unit which is designed for the purpose of comparing detected pressure values or consequential values depending on the latter with one another and/or with at least one predefined reference value and of outputting a break signal when at least one break condition is fulfilled. On the basis of the break signal, the reactive measures mentioned can then be initiated and the break can be signaled to the operating personnel. Based on the method according to the invention, it is proposed that detected pressure values or consequential values dependent on the latter be compared with one another and/or with at least one predefined reference value in order to determine the fulfillment or non-fulfillment of at least one break condition.

Thought is above all given to the evaluation unit being designed for the purpose of comparing the magnitude of pressure values or consequential values corresponding to the latter recorded successively in order to check a break condition, the break condition being fulfilled when the values deviate from a predefined reference curve. In relation to the method according to the invention, it is accordingly proposed that, according to one break condition, pressure values or consequential values corresponding to the latter recorded successively be compared with one another, and that the break condition be determined to be fulfilled when the values deviate from a predefined reference curve.

According to an expedient embodiment, the break condition is fulfilled when, in the case of a vacuum device, a pressure value that is assigned to a later time is greater than or equal to a pressure value that is assigned to an earlier time or, in the case of a positive pressure device, a pressure value that is assigned to a later time is less than or equal to a pressure value that is assigned to an earlier time. Based on the method according to the invention, it is proposed that the break condition be determined to be fulfilled when, in the case of a vacuum device, a pressure value that is assigned to a later time is greater than or equal to a pressure value that is assigned to an earlier time or, in the case of a positive pressure device, a pressure value that is assigned to a later time is less than or equal to a pressure value that is assigned to an earlier time.

This embodiment of the evaluation unit and the method is expedient and reliable when the pressure values or consequential values compared with one another are assigned to times which, as based on the web speed and the rate at which the transfer strip or the material web is widened, have a certain minimum spacing in time, so that in the event of a successful, proper curve, it is always ensured that for increasing times the operating pressure falls (in the case of a vacuum device) or rises (in the case of a positive pressure device), which, in the case of processing consequential values derived from the pressure values, applies appropriately to these. If, on the other hand, an evaluation of pressure values or consequential values lying closer to one another in time is provided, then, on account of relatively small pressure fluctuations which may possibly occur, this could lead to the detection of a break although such a one has actually not occurred. In order to avoid such erroneous detection, it is possible for a tolerance band, for example expressed by a threshold value, also to be included in the comparison. In this regard, it is proposed in practical terms that the break condition be fulfilled when, in the case of a vacuum device, a pressure value assigned to a later time exceeds a pressure value assigned to an earlier time by a predefined threshold value or, in the case of a positive pressure device, a pressure value assigned to a later time falls below a pressure value assigned to an earlier time by a predefined threshold value. Based on the method according to the invention, it is accordingly proposed that the break condition be determined to be fulfilled when, in the case of a vacuum device, a pressure value assigned to a later time exceeds a pressure value assigned to an earlier time by a predefined threshold value or, in the case of a positive pressure device, a pressure value assigned to a later time falls below a pressure value assigned to an earlier time by a predefined threshold value.

According to a particularly expedient development, the evaluation unit is designed for the purpose of comparing detected pressure values or consequential values dependent on the latter with a predefined reference value, in order to check a tail-widening finished condition which is fulfilled when the pressure value reaches a threshold value corresponding to the reference value. In relation to the method according to the invention, it is proposed that detected pressure values or consequential values dependent on the latter be compared with a predefined reference value, in order to determine the fulfillment or non-fulfillment of a tail-widening finished condition, which is determined to be fulfilled when the pressure value reaches a threshold value corresponding to the reference value.

On the basis of the fulfillment of the tail-widening finished condition, the apparatus for detecting a break in the material web can be changed over to a normal operation monitoring mode, in which monitoring for the occurrence of a web break can then be carried out in a conventional way.

Thought is specifically given, in the case of a machine with a plurality of sections (in particular a plurality of drying groups and material web treatment devices) in each case monitored separately for a break during the increase in the width of the transfer strip, to changing to the normal operation monitoring mode in each case separately for the respective section when the fulfillment of the tail-widening finished condition is determined for this section. Conventional break detection systems are activated only when the material web has been widened completely over the entire machine.

It has already been mentioned that the machine can expediently be designed for the purpose of initiating at least one reactive measure automatically in response to the detection of a break in the material web, in order to avoid damage to the machine as a result of the break and/or to prepare for a renewed transfer of the material web. The reactive measure provided can be one or more of of the following measures: triggering a web knock-off, setting machine components into a waiting or safe state, activating the positive pressure or vacuum device for the renewed transfer of the material web, activating the apparatus for forming and transferring the transfer strip for the renewed transfer of the material web.

According to the first aspect, the invention also provides an apparatus for implementing the method according to the invention, for example for providing a machine according to the invention, for example by equipping or retrofitting a machine as mentioned at the beginning.

According to another (second) aspect, the invention further provides a machine for the production and/or treatment of a material web, in particular of paper or board, in which the material web can be guided along a material web guide path by means of at least one material web guide device from a material web production section or material web input section, in order to pass at least one material web treatment device, having an apparatus for detecting a break in the material web on the basis of a detected operating pressure of a vacuum device having a suction box.

According to the invention, provision is made for at least one pressure sensor for detecting the operating pressure to be arranged in the suction box. It has been shown that a pressure sensor arranged at this point can respond particularly reliably to pressure changes resulting from a web break. The same applies to web break detection in conjunction with the threading or tail widening of the material web according to the first aspect of the invention. Furthermore, on the basis of the pressure detected here, a diagnosis of components of the vacuum device or of an associated vacuum source (for example a fan arrangement) can be carried out particularly reliably. Erroneous detections of a break and erroneous diagnoses relating to such components are avoided in this way. If the suction box has a transfer suction zone which is assigned to the transfer strip and an operating suction zone which, together with the transfer suction zone, is assigned to the full material web width and is connected or is able can be connected via the transfer suction zone to a vacuum source, it is preferred for the pressure sensor to be arranged in the operating suction zone.

With regard to the machine and the apparatus according to the first aspect of the invention, reference should further be made to the following. The evaluation unit can be constructed on the basis of an electronic computer unit, in particular a microprocessor arrangement, on which there runs an evaluation program which has software functionalities providing the comparison of the values and the testing of the various conditions. With regard to the values to be compared, it should be pointed out that it is not absolutely necessary for original pressure measured values to be processed but that values or data derived from these, the "consequential values" mentioned above, can be processed in order to test for the break condition or break conditions and the tail-widening finished condition. It is also possible for electrical signals to be compared with one another as the pressure or consequential values mentioned, for example measuring sensor output signals or converter output signals, for example output signals from a P-I converter without conversion into pressure values, possibly even in an analog manner not providing any digital to analog conversion.

Within the context of the invention, in addition to the criteria and characteristic values mentioned directly here for the instantaneous state during the tail widening or the occurrence of a break, other criteria and characteristic values can also be used, in particular including the criteria and characteristic values quoted in the publications mentioned above. Reference is made in particular to the documents DE 101 31 281 A1, DE 201 03 070 U1, DE 42 16 653 C2 and EP 0 660 898 B1.

According to the invention, monitoring both of the normal operation of the machine and at least of the tail widening during the web transfer (web threading) is possible and provided. Developing this, thought is also given to monitoring the transfer of the transfer strip or its threading section with regard to a break automatically as well, for example on the basis of the known detection techniques mentioned.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention will be explained in more detail in the following text using exemplary embodiments shown in the figures, in which.

DETAILED DESCRIPTION OF THE PRESENT INVENTION

Figure 1:
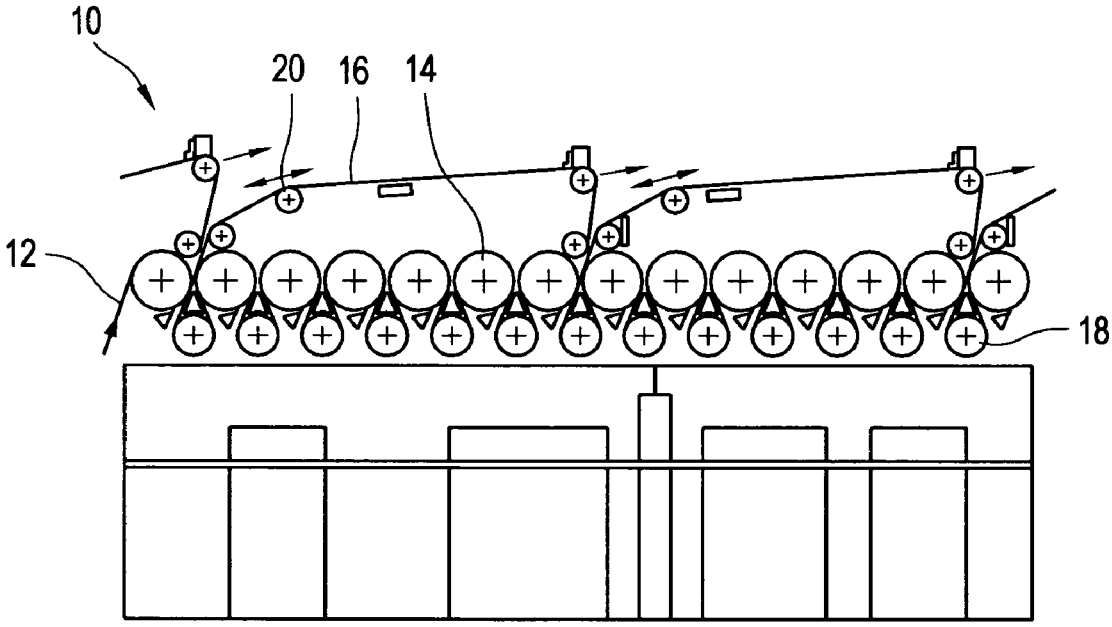
FIG. 1 shows a schematic illustration of a portion of a papermaking machine according to an exemplary embodiment of the invention.

FIG. 1 shows in schematic form a side view of a detail of a drying section of a papermaking machine or paper processing machine designated generally by 10. In a manner known per se, a drying section within a paper machine fulfills the function of extracting moisture from a material web that has been produced or processed, that to say of drying said web. In the example shown in FIG. 1, this is carried out by means of contact drying, a material web 12 to be fed in from the left in the drawing being dried by direct contact with a plurality of drying cylinders 14 on one side and an endless dryer felt 16 running around the drying cylinders 14 on the other side. In FIG. 1, two dryer felts 16 are illustrated over their complete circulation path, each of the dryer felts 16 in each case running around a group of drying cylinders 14. More precisely, each dryer felt 16 runs up and down in the form of a wave in the region of the drying cylinders 14, the dryer felt 16 being deflected by a drying cylinder 14 at the peak of the wave and being deflected by a suction roll of a respective vacuum device 18 in the trough of the wave. After leaving the last drying cylinder 14 of the corresponding group, the dryer felt 16 is guided back to the first drying cylinder 14 of the group again over a plurality of guide rolls 20.

To provide the break monitoring according to the invention, for each group of drying cylinders 14, at least one vacuum device 18 is equipped with an apparatus for detecting a material web break, which will be described in more detail later.

To dry the material web 12, this is introduced into the system comprising drying cylinders 14 and vacuum devices 18 such that it is guided on the drying cylinders 14 pressed between the dryer felt 16 and the surface of the drying cylinder 14, while it runs around the vacuum devices on the outside on the dryer felt 16.

When the machine 10 is started up, following the feeding of a new material web or after a break in the material web, it is necessary to re-introduce a leading transfer strip of the material web into the roll system of the drying section and, in the process, to transfer it alternately between a drying cylinder 14 and a vacuum device 18. In order in this case to deflect the transfer strip deflected on the outside on a vacuum device 18 counter to the force of gravity and feed it to the following drying cylinder 14, the vacuum devices 18 are connected to a vacuum source, at least during the transfer operating state of the machine, so that the vacuum device 18 forces the transfer strip onto the predefined material web path by means of suction.

The transfer strip is generally cut directly out of the material web automatically before the threading of the material web, by using a suitable device, for example what is known as a couch jet. A device of this type can, for example, comprise a cutting device that can be displaced transversely with respect to the running direction of the material web, for example a water jet or laser cutting device, a circular knife or the like or what is known as a strip knock-off device. During the cutting or the formation of the transfer strip, the material web moves in the running direction. In the following text, the use of a couch jet in a papermaking machine will be assumed. The couch jet is initially in a strip position and cuts a narrow frontmost section of constant width as a threading section or else a ribbon, which is guided through the machine by means of suitable guide means. Following a specific advance distance of the material web, the couch jet is moved uniformly in the direction of the opposite edge of the material web and thus cuts the transfer strip with preferably uniformly increasing width, until it reaches the full width of the material web and the cutting of the transfer strip has been completed. In the process, the material web moves continuously onward and is threaded into the paper machine.

A vacuum device 18 provided for use in a paper machine according to the present exemplary embodiment and serving as a vacuum deflection device, having an apparatus for detecting a material web break, will be explained in more detail in the following text with reference to FIGS. 2 and 3. It comprises a suction roll 22, on which the material web 12 is deflected, and also a suction box 24. The suction box 24 is connected via a connecting line 26 to a vacuum source, not shown, in order to be able to generate a vacuum in the suction box 24. The suction box 24 adjoins the suction roll 22 and has openings 28 facing the latter. A vacuum built up in the suction box 24 can progress into the interior of the suction roll 22 through these openings 28 and through drilled holes 30 in the shell of the suction roll 22, so that a vacuum can also be built up in the suction roll 22.

If a vacuum is generated and maintained in the suction box 24 and in the suction roll 22, this vacuum is propagated through the drilled holes 30 of the suction roll 22 that are currently not opposite the suction box 24 and through further openings 32 in the suction box 24 to the outside and through the porous dryer felt 16 running around the vacuum device 18, and attracts by suction a material web section to be deflected at the vacuum device 18, in particular a transfer strip to be transferred, in order to hold the latter on the material web guide path and feed it to the following drying cylinder 14.

Figure 2:
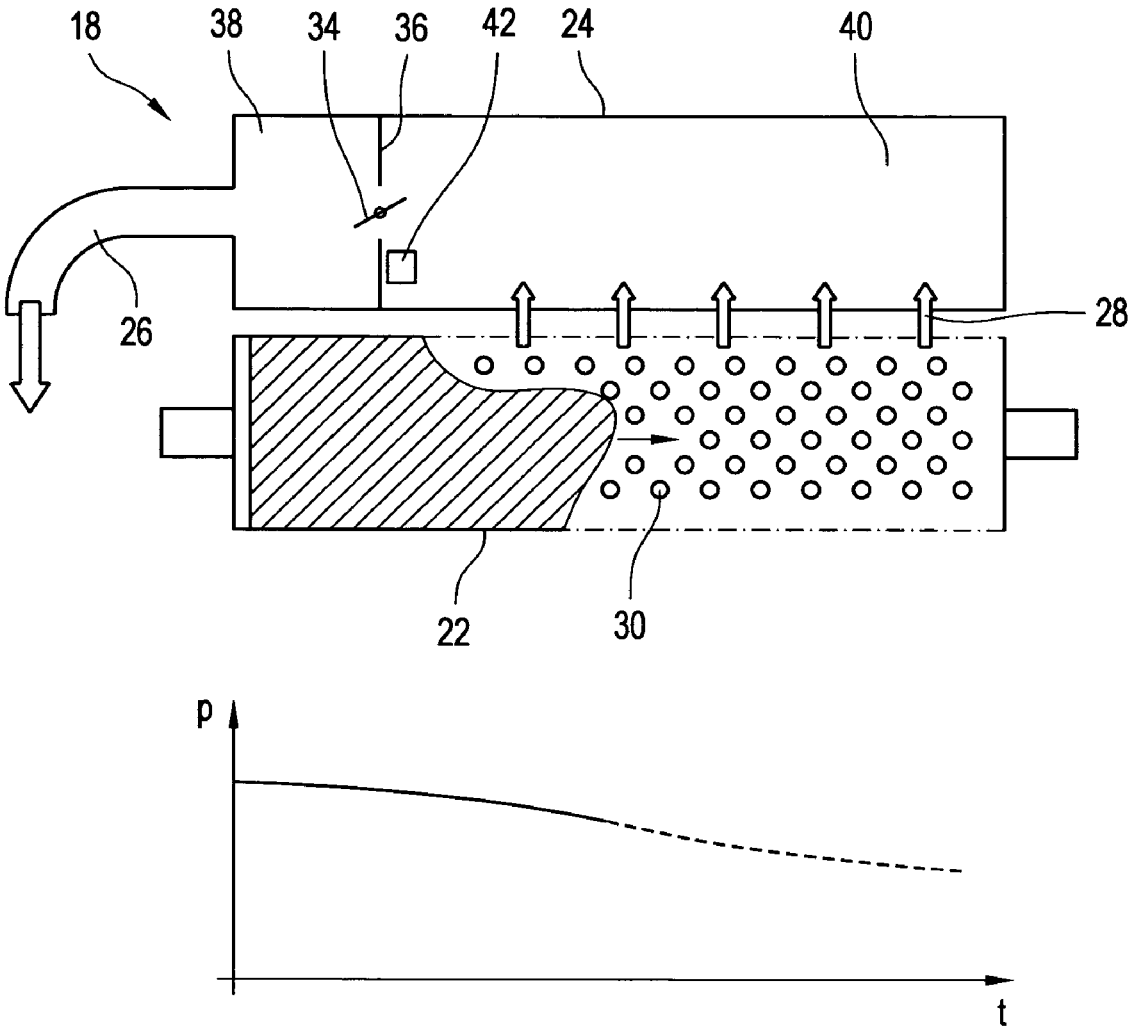
FIG. 2 shows a plan view of a vacuum device having a pressure detection arrangement according to the invention.
Figure 3:
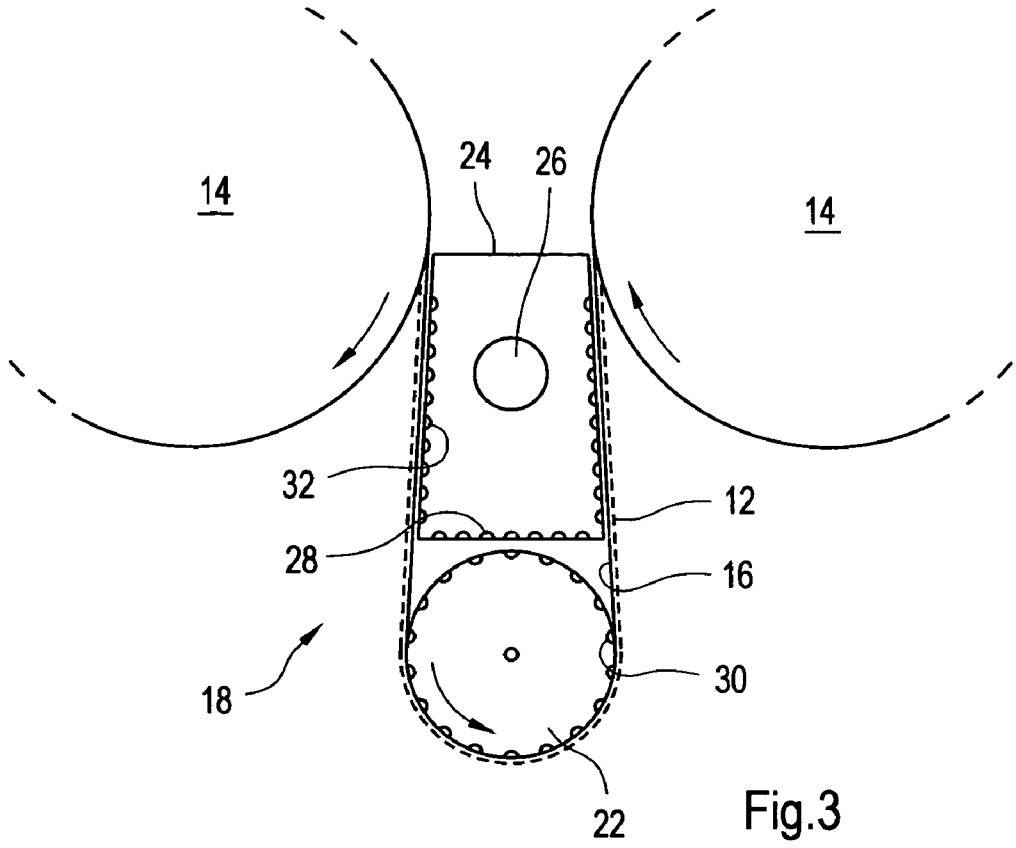
FIG. 3 shows a front side view of the vacuum device from FIG. 2.

A valve 34 and a dividing wall 36 are also indicated in FIG. 2. The dividing wall 36 divides the interior of the suction box 24 into a transfer suction zone 38 and an operating suction zone 40, it being possible for the transfer suction zone 38 and the operating suction zone 40 to be connected to each other or isolated from each other by the valve 34. The width of the transfer suction zone 38, measured in the material web transverse direction, corresponds approximately to the width of the advancing threading section of the transfer strip of the material web. During the transfer of the transfer strip of a material web to be newly threaded in, the valve 34 is closed, so that air is sucked out only from the transfer suction zone 38 of the suction box 23 and from the suction roll 22 via the connecting line 26. In this way, the regions of the suction box 24 which are not covered by material web during the transfer of the transfer strip are not evacuated, in order to be able to use the suction power of the vacuum source to build up a vacuum in the transfer suction zone 38.

The front threading section of the transfer strip is followed by a further section, in which the width of the transfer strip increases continuously, until the transfer strip ultimately reaches the full width of the actual material web and, at this point, merges in one piece into the actual material web or is connected to the latter. The operating state of the paper machine in which the continuously widening transfer strip is transported is designated "tail widening" of the material web. During the tail widening of the material web, the valve 34 is opened and an approximately uniform vacuum is built up both in the transfer suction zone 38 and in the operating suction zone 40 and in the suction roll 22. This vacuum which builds up is counteracted by the air taken in, which is taken in through those drilled holes 30 and those openings 32 which are not yet covered by the transfer strip. The pressure established in the suction box 24 accordingly depends on the number of openings 30 and 32 not covered by the transfer strip, given a constant suction power of the vacuum source. This number decreases continuously with increasing width of the transfer strip, so that the air stream entering the suction box 24 from outside and counteracting the evacuation of the suction box 24 also decreases. With increasing width of the transfer strip, the pressure within the suction box 24 thus decreases, until it reaches a minimum value after the complete tail widening of the material web. The operating pressure p in the suction box 24, decreasing with the width of the transfer strip, is illustrated schematically in the graph of FIG. 2.

The apparatus according to the invention for detecting a break in the material web uses the curve previously described of the pressure within the suction box 24 during the tail widening of the transfer strip of the material web in order to monitor correct tail widening and, in particular, to detect the occurrence of a break in the transfer strip. For this purpose, in the suction box 24, more precisely in the operating suction zone 40 of the suction box 24, a pressure sensor 42 which detects the pressure in the suction box 24 is arranged. The pressure sensor 42, as shown in FIG. 2, is preferably arranged close the behind the dividing wall 36 in the suction box 24. The arrangement of the pressure sensor 42 in the suction box 24 is advantageous, since the flow cross section is relatively large in the suction box 24 and, as a result, pressure fluctuations are relatively small.

The pressure sensor 42 is connected to a P-I converter (pressure-current converter, not shown), which outputs a current signal representing the magnitude of the measured pressure to an electronic control unit (not shown). The electronic control unit can also be supplied a position signal, which indicates the travel position of the couch jet transversely with respect to the running direction of the material web. From the speed of the material web and the distance from the couch jet as far as the monitoring vacuum device, an instantaneous reference web width of the transfer strip at the monitoring vacuum device can then be determined in the electronic control unit or in a computing unit connected upstream, in order to provide said reference web width to the control unit.

The control unit is configured in such a way that, in a manner to be described in more detail later, on the basis of the instantaneous current value transmitted to it by the P-I converter and, possibly, also the instantaneous reference web width, it makes a decision as to whether there is a break in the material web, in particular its transfer strip, or not. The electronic control unit is also set up and implemented in the paper machine such that, in the event that a web break is established, it can initiate or carry out specific measures in reaction to the web break. In particular, thought is given to the electronic control unit being connected to a knock-off device, which knocks the material web off upstream of the break point in the event of a break, in order to avoid damage to the machine by winding operations and to prepare the web for new threading. As further measures, provision can be made to move the couch jet for cutting the transfer strip to a strip position, to transfer various device units of the production or processing sections into a waiting position, to move vacuum transport devices back or to initialize them (close vacuum breaker valves) or to indicate the occurrence of the web break to the operating personnel. Further measures which have to be taken upon the occurrence of a web break are obvious to those skilled in the art.

The electronic control unit according to the exemplary embodiment of the invention is further set up for the purpose of detecting the successful completion of the tail widening and outputting a corresponding tail-widening finished signal. As a reaction to this tail-widening finished signal, the paper machine can be changed automatically to a normal operating mode, in which for example a normal operating monitoring mode for the detection of a break in the material web is switched on, in which, for example, the break in the material web can be detected in a manner known per se. Further measures which have to be carried out when the paper machine is changed from the transfer and tail-widening mode to the normal operating mode are familiar to those skilled in the art.

Figure 4:
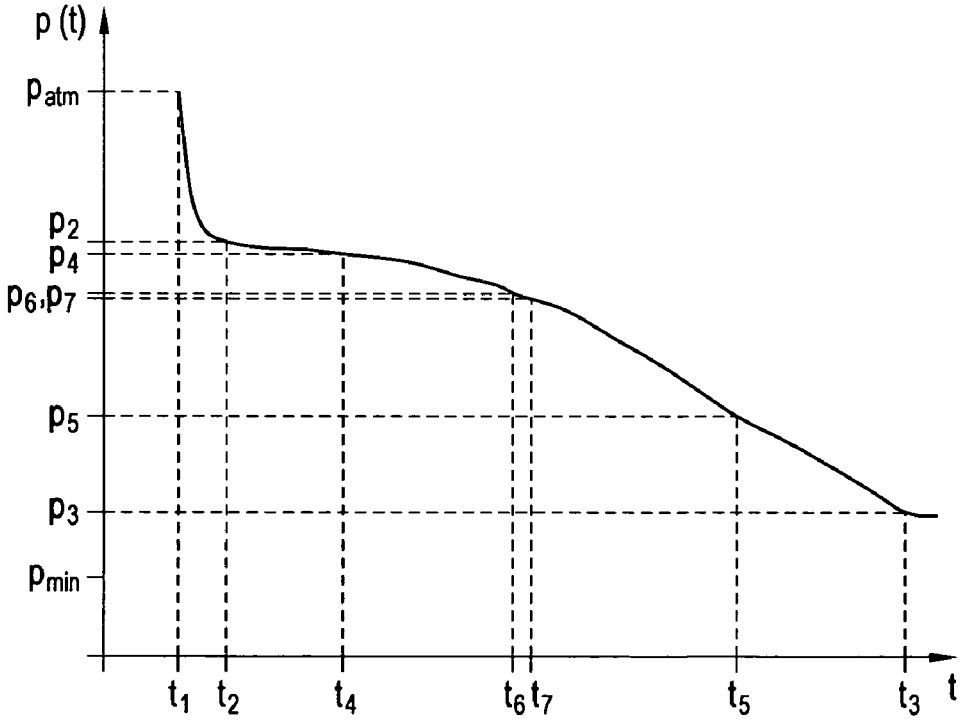
FIG. 4 shows the curve over time of the pressure within the vacuum device during the tail widening of a transfer strip of a material web.

With reference to FIG. 4, in the following text the functioning of the electronic control unit of the exemplary embodiment for detecting a web break and for detecting completely successful tail widening of the material web will be explained. The graphical illustration shows the curve of the pressure p measured by the pressure sensor 42 in the period beginning shortly before the start of the tail widening $t_1$ (shortly before the opening of the valve 34) as far as a time shortly after the complete tail widening of the material web. During the transfer of the threading section of the transfer strip, that is to say for times $t<t_1$, the valve 34 is closed and the pressure p within the operating suction zone assumes relatively high values in the vicinity of normal atmospheric pressure. As soon as the width of the transfer strip begins to become greater, the valve 34 is opened, which means that the operating suction zone 40 is then also connected to the connecting line 26 and air is extracted from the operating suction zone 40. The measured pressure p therefore falls rapidly shortly after the time $t_1$ of the opening of the valve 34 and, shortly thereafter, at a time $t_2$, reaches a pressure $p_2$ which corresponds to the presence of a transfer strip of minimum width. During the further transport of the transfer strip, its width increases gradually, so that more and more of the openings 30 and 32 are covered by material web and the pressure p consequentially decreases continuously. The pressure p reaches its minimum value $p_3$ at the time $t_3$, when the width of the transfer strip becomes a maximum and reaches the width of the actual material web. After the complete tail widening of the material web, that is to say for times $t>t_3$, the pressure p remains substantially constant, since the number of holes 30 and 32 covered by the material web then no longer changes.

The pressure curve shown in FIG. 4 corresponds to a reference pressure curve during proper tail widening of the material web. The electronic control unit detects the occurrence of a web break during the tail widening in that at least one pressure value measured at a specific time deviates significantly from the pressure curve illustrated in FIG. 4. In this case, the accuracy and reliability of the break detection depend on the knowledge of operating parameters and on fluctuations of the operating parameters over time. These operating parameters include in particular the position of the valve 34 (throttle angle) and the power of the vacuum source connected to the suction box.

In order to detect a web break, in particular the following three design variants of a method for break detection can expediently be used.

In a first design variant, the reference pressure curve shown in FIG. 4 is stored in a memory of the electronic control unit and/or can be calculated by the control device on the basis of the instantaneous reference web width and on the basis of operating parameters of the paper machine, in particular the suction power of the vacuum source. In principle, the knowledge of a single point on the pressure curve would be sufficient to be able to carry out the detection of a web break at this time, but advantageously the reference pressure curve will be available to the electronic control unit for a large number of times, in order to be able to provide the most continuous possible web break monitoring. The reference pressure values of the reference pressure curve available to the electronic control unit are now compared with the actual pressure values measured by the pressure sensor 42, and the break in the material web is detected exactly at the point when the actual pressure at a specific time exceeds the corresponding reference pressure significantly, that is to say by a predetermined threshold value (tolerance band). In the event of a web break, this is because the openings 30 and 32 of the suction roll 22 and the suction box 24 are exposed in a short time, so that air can penetrate through these into the suction roll 22 and the suction box 24 and effects a sudden pressure rise. In any case, however, there is a lack of increasing coverage of further openings 30, 32, so that the pressure at least does not fall further.

The magnitude of the threshold value can be set as a function of the magnitude of possible pressure fluctuations in the suction box 24, such that a random pressure rise, for example on account of short-term fluctuations in the suction power of the vacuum source or on account of short-term lifting of the material web at some points, does not lead to detection of a web break.

In the method according to the first design variant, the successful complete tail widening can additionally be detected by the fact that, for times $t>t_3$, the measured pressure, apart from a threshold value, is equal to a pressure $p_3$, that is to say a tail-widening finished signal can be output when the difference between the measured actual pressure and the reference pressure $p_3$ falls below the threshold value.

The pressure $p_3$ corresponds to an extremely small pressure when the material web tail is widened completely and which is also established during the normal operating mode. The pressure $p_3$ should advantageously lie close to a minimum pressure $p_{min}$, which corresponds to the best possible evacuation of the suction box 24 and the suction roll 22 by the vacuum source. In most cases, however, the pressure $p_3$ will be higher than the minimum achievable pressure $p_{min}$, since the material web will barely cover the openings 30 and 32 completely in a sealing manner (in particular also when a narrower material web is used) and certain leaks normally occur in the vacuum device.

In a second design variant, the electronic control device does not compare measured pressure values directly with reference pressure values from the reference pressure curve but compares two pressure values $p_4$ and $p_5$ recorded at different time $t_4$ and $t_5$ with each other. In the case of proper tail widening of the transfer strip, in accordance with the curve shown in FIG. 4, the pressure value $p_5$ recorded at the later time $t_5$ must be smaller than the pressure value $p_4$ recorded at the time $t_4$. If this is not the case, the control device concludes that there is a break in the transfer strip. This design variant has the advantage that it manages without any predefinition or calculation of reference pressure values and detects a web break by using the simple break condition that a pressure value recorded at a later time is not smaller than a pressure value recorded at an earlier time.

Furthermore, a third design variant for detecting a break of the transfer strip during tail widening is conceivable, in which the break is detected on the basis of the comparison of two pressure values $p_6$, $p_7$ recorded at a short time interval (at $t_6$, $t_7$). Although in this case, too, the use of a break condition according to the second design variant is in principle possible, it would be possible for erroneous triggering of a break signal to occur in the case of pressure measurements following one another closely in time, because of random pressure fluctuations within the suction box 24. As can be seen in FIG. 4, this is because the reference pressure values $p_6$ and $p_7$ are also relatively close to each other and their difference can lie in the range of the order of magnitude of random pressure fluctuations. According to the third design variant, a web break signal is therefore generated only when the pressure $p_7$ measured at the time $t_7$ exceeds the pressure $p_6$ measured at the earlier time $t_6$ by at least a predetermined threshold value s, therefore when $p_7(t_7)>p_6(t_6)+s$. By using such a break condition, reliable break detection is possible even during the evaluation of pressure measurements following one another closely over time.

The aforementioned three design variants for detecting a material web break in the region of the profile strip can be combined with one another as desired, in order to provide the most optimal break detection possible. It is viewed as particularly preferred if the electronic control unit is continuously supplied with pressure values from the pressure sensor 42 (or the current values from the P-I converter representing the pressure values) and the electronic control unit monitors the instantaneously received pressure values continuously for a deviation from the reference pressure curve shown in FIG. 4. Furthermore, a combination of the first and third design variants can be configured in such a way that the threshold value s used for the break condition according to the third design variant is adapted as a function of the measured pressure, in order to provide a variable threshold value s (p) which takes account of the changing rise in the pressure curve or a variable amplitude of the fluctuation of the pressure as a function of the pressure.

A combination of the above-described three design variants can also expediently be used in assessing tail widening which has been completed successfully, in order to generate the tail-widening finished signal. For example, a tail-widening finished condition can be used which indicates successful tail widening when the break conditions according to the design variants 1 and 2 have not been triggered and the pressure p reaches a reference pressure value $p_3$ (third design variant).

The paper machine described in more detail above is to be understood as a preferred exemplary embodiment of the invention. Within the scope of the invention, it is not only possible for a continuous pressure drop (vacuum rise) in the suction box to be used as a monitoring variable for current tail widening of the transfer strip; instead it is also possible to monitor the continuous widening of the transfer strip with a large number of optical sensors or temperature sensors or the like arranged transversely with respect to the material web. In principle, the same electronic control device as has been described above in detail can then be used for various measuring methods, as long as a signal representing the instantaneous actual width of the transfer strip is supplied to it. In this connection, it should be underlined once more that the pressure variables ($p_1$ to $p_7$, see FIG. 4) used in the description of the embodiment were merely designated pressure variables for improved illustration. However, in most cases, instead of the direct pressure values, the electronic control unit will process equivalent signal values (current signal values, voltage signal values, etc.) which are related to the pressure p measured by the pressure sensor 42. In the case in which a directly proportional relationship is provided for the relationship between these signal values and the actual pressure p, all the statements relating to pressure values (break conditions etc.) made in this description and in the claims can be applied in an equivalent way to the corresponding signal values. In the case in which other relationships between the signal values processed in the electronic control unit and the pressure values are used, those skilled in the art will readily be in a position to formulate break conditions or processing rules for the electronic control unit by using the above-described relationships.

Furthermore, it should be pointed out once again that the method according to the invention can also be applied to other sections of the paper machine, for example to the press section, the predryer and/or afterdryer section, to a coating machine, a calender, a reeler, etc.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

The invention claimed is:

1. A method for monitoring the transfer of a material web of paper or board along a material web guide path of a machine for producing and/or treating the material web, the transfer of the material web being carried out in that a leading transfer strip of the material web is guided through the machine and the width of the transfer strip is increased to the full material web width (what is known as "tail widening"), wherein, during the transfer of the material web, monitoring for a break in the transfer strip is carried out on the basis of at least one detection variable representing the width of the transfer strip.

2. The method as claimed in claim 1, wherein monitoring for a break in the transfer strip or the material web is carried out on the basis of at least one detection variable (p) representing the width of the transfer strip, directly or indirectly.

3. The method as claimed in claim 1, wherein the monitoring is carried out on the basis of optical detection, in particular optical detection of the width of the transfer strip and/or detection of temperature values.

4. The method as claimed in claim 1, wherein the monitoring is carried out on the basis of detection of at least one of pressure values (p), pressure change values and a pressure change.

5. The method as claimed in claim 4, wherein at least one instantaneous operating pressure (p) of at least one of the vacuum device, positive pressure device acting on the material web and a transfer strip is detected.

6. The method as claimed in claim 5, wherein detected pressure values (p) or consequential values dependent on the latter are compared with one another and/or with at least one predefined reference value ($p_{min}$, $p_2 \ldots p_7$) in order to determine the fulfillment or non-fulfillment of at least one break condition.

7. The method as claimed in claim 6, wherein, according to one break condition, pressure values (p) or consequential values corresponding to the latter recorded successively are compared with one another, and in that the break condition is determined to be fulfilled when the values (p) deviate from a predefined reference curve.

8. The method as claimed in claim 5, wherein the break condition is determined to be fulfilled when, in the case of a vacuum device (18), a pressure value ($p_5$) that is assigned to a later time ($t_5$) is greater than or equal to a pressure value ($p_4$) that is assigned to an earlier time ($t_5$) or, in the case of a positive pressure device, a pressure value that is assigned to a later time is less than or equal to a pressure value that is assigned to an earlier time.

9. The method as claimed in claim 5, wherein the break condition is determined to be fulfilled when, in the case of a vacuum device, a pressure value ($p_7$) assigned to a later time ($t_7$) exceeds a pressure value ($p_6$) assigned to an earlier time ($t_6$) by a predefined threshold value (s) or, in the case of a positive pressure device, a pressure value assigned to a later time falls below a pressure value assigned to an earlier time by a predefined threshold value.

10. The method as claimed in claim 4, wherein detected pressure values (p) or consequential values dependent on the latter are compared with a predefined reference value, in order to determine the fulfillment or non-fulfillment of a tail-widening finished condition, which is determined to be fulfilled when the pressure value (p) reaches a threshold value corresponding to the reference value.

* * * * *